US006903705B2

(12) United States Patent
Livadiotti

(10) Patent No.: US 6,903,705 B2
(45) Date of Patent: Jun. 7, 2005

(54) RADIO BROADCASTING DEVICE AND RELAY TOWER THEREFOR

(76) Inventor: Emmanuel Livadiotti, 7/9 boulevard du Temple, 75003 Paris (FR)

( * ) Notice: Subject to any disclaimer, the term of this patent is extended or adjusted under 35 U.S.C. 154(b) by 125 days.

(21) Appl. No.: 10/234,927

(22) Filed: Sep. 4, 2002

(65) Prior Publication Data

US 2003/0095077 A1 May 22, 2003

Related U.S. Application Data

(63) Continuation of application No. PCT/FR01/00688, filed on Mar. 7, 2001.

(30) Foreign Application Priority Data

Mar. 7, 2000 (MA) ..... 25078
Mar. 6, 2001 (FR) ..... 01 03051

(51) Int. Cl.[7] ..... H01Q 1/12
(52) U.S. Cl. ..... 343/890; 343/874
(58) Field of Search ..... 343/874, 875, 343/890, 891

(56) References Cited

U.S. PATENT DOCUMENTS 2,334,279 A * 11/1943 Samoilovich ..... 343/703
2,844,819 A * 7/1958 Andrews ..... 343/874
4,145,696 A * 3/1979 Gueguen ..... 343/792.5
4,763,132 A * 8/1988 Juds et al. ..... 343/890
5,200,759 A * 4/1993 McGinnis ..... 343/890
5,649,402 A * 7/1997 Moore ..... 52/651.02
6,016,123 A 1/2000 Barton et al. ..... 342/373
6,115,004 A * 9/2000 McGinnis ..... 343/890

FOREIGN PATENT DOCUMENTS

| | | |
|---|---|---|
| EP | 0 239 653 | 7/1987 |
| WO | 98/54426 | 3/1998 |
| WO | 98/39851 | 9/1998 |

* cited by examiner

*Primary Examiner*—Shih-Chao Chen
(74) *Attorney, Agent, or Firm*—DLA Piper Rudnick Gray Cary US LLP

(57) ABSTRACT

A tower for a wireless transmission device including at least one shaft extending upwardly between top and bottom portions, transverse spars extending outwardly from the shaft, at least one brace connected to at least one of the spars and extending between the top and bottom portions, wherein the transverse spars are articulated in relation to the shaft and form, in conjunction with the braces, cells conserving parallelism of the spars.

18 Claims, 4 Drawing Sheets

RADIO BROADCASTING DEVICE AND RELAY TOWER THEREFOR

RELATED APPLICATION

This is a continuation of International Application No. PCT/FR01/00688, with an international filing date of Mar. 7, 2001, which is based on Moroccan Patent Application No. 25078, filed Mar. 7, 2000, and French Patent Application No. 01/03051, filed Mar. 6, 2001.

FIELD OF THE INVENTION

This invention pertains to the domain of wireless transmission equipment.

BACKGROUND

Such equipment is used in the field for telephonic transmissions both at the level of telecommunications such as the antennas for the GSM (Global System for Mobil Communications) and PCS (Personal Communications Services) systems, and more generally for wireless telephonic transmissions that other present or future technologies would require for aerial connections.

Known in the state of the art are various mast and tower solutions intended for telephonic transmission. Also known are telescopic masts whose essential value is to enable a tapering structure that conserves optimal wind resistance.

As an example, French patent FR 2,745,423 describes an antenna support comprising two parallel braces articulated close to each other by one end at the base of a rigid support, and attached to a vertical mast so as to form a quadrilateral deformable in the vertical plane so as to regulate the slope of the antenna.

WO 98/58420 pertains to a cellular site mast assembly that is integrated with various antennas and constituted such that the assembly is easy to install on a cellular site without having to use extensive or analogue cabling. The assembly also comprises a light glass fiber housing which surrounds the antenna without disturbing its operation. The assembly presents a balancing system that allows raising or lowering the housing in order to gain access to the antenna.

WO 99/66589 describes an antenna configuration intended to be used particularly with a cellular telephone system in a rural environment. This antenna apparatus comprises a hollow steel support column covered by a hollow glass-fiber-reinforced plastic sheath, for example. The support column and the sheath are designed so as to present an exterior appearance simulating the bark of a tree such as a Scotch pine. The column is bolted to a concrete base placed below ground level and presents a cover simulating tree roots. The sheath carries and covers an omnidirectional antenna attached to a feed line passing through the column and the conduit located inside the concrete base. The equipment compartment of a base station of the cellular telephone system is connected to the antenna feed line.

European patent EP 106,069, entitled "Telescopic mast intended to support an antenna" provides for the pneumatic adjustment of telescopic tubes, the value of which is that it can be installed very quickly on the site and it is very compact.

European patent EP 57,002, entitled "Telescopic antenna mast" describes an apparatus whose value is solely to provide a telescopic system for devices at very elevated heights.

In these support systems, emphasis is generally on the greatest rigidity so as to maintain the most perfect aiming, a characteristic that increases in importance as the frequency of the transmissions increases and the spacing between supports increases. In fact, an increase in the frequency means a greater directivity of the radiation (propagation tending towards an optical behavior) and consequently the requirement of greater precision in the transmission. Without this precision, the communication coverage is faulty and the network can even fail.

The consequence is that high rigidity of the supports generally results in a more robust constitution, and therefore the use of more materials of higher quality.

To compensate for the expenses generated by the requirement for larger and heavier towers, the current practice, especially in the case with which we are concerned in the present typically for GSM support towers, is to use a trellis system constituted of portions of metal profiles riveted and/or welded to each other. The calculations for this metal construction start from specifications that indicate notably the resistance to weather, e.g., deformation by wind, so as to ensure the operations of the network and communication coverage. As an indication, for GSM the value of the aim loss must not exceed 20' in the case of strong winds.

The present increasingly widespread use of mobile telephones and the services that are and will be associated with them (e.g., access to databases and the Internet) means that the requirements for antenna support towers are becoming more important and simultaneously imposing problems of the material and fabrication costs of these supports, the time required for their preparation as well as their transport, their assembly and their installation. In urban areas particularly, so as to ensure that users have perfect coverage, installers tend to mount their antennas on the roofs of the tallest buildings, which creates numerous attachment problems, since the present supports, due to the required rigidity, require extensive bracing.

Finally, in terms of the environment, the present proliferation of GSM towers of a certain volume threatens to disfigure the landscape. The state of the art in antenna support towers reveals, in addition to the desire to reduce the bulk of these systems, other fundamental requirements such as rapidity of assembly, decrease in the drag, more rapid attachments and resistance to vandalism (case of isolated posts). The impact of a decrease in weight affects not only the cost of the raw materials but also the transport cost and the cost of the material for its implementation.

SUMMARY OF THE INVENTION

This invention relates to a tower for a wireless transmission device including at least one shaft extending upwardly between top and bottom portions, transverse spars extending outwardly from the shaft, at least one brace connected to at least one of the spars and extending between the top and bottom portions, wherein the transverse spars are articulated in relation to the shaft and form, in conjunction with the braces, cells conserving parallelism of the spars.

BRIEF DESCRIPTION OF THE DRAWINGS

As a nonlimitative example presented to facilitate comprehension of the principles, means and processes that can enable implementation of the invention, we provide schematic illustrations of several particular modes of implementation on the three attached sheets.

DETAILED DESCRIPTION

Figure 1:
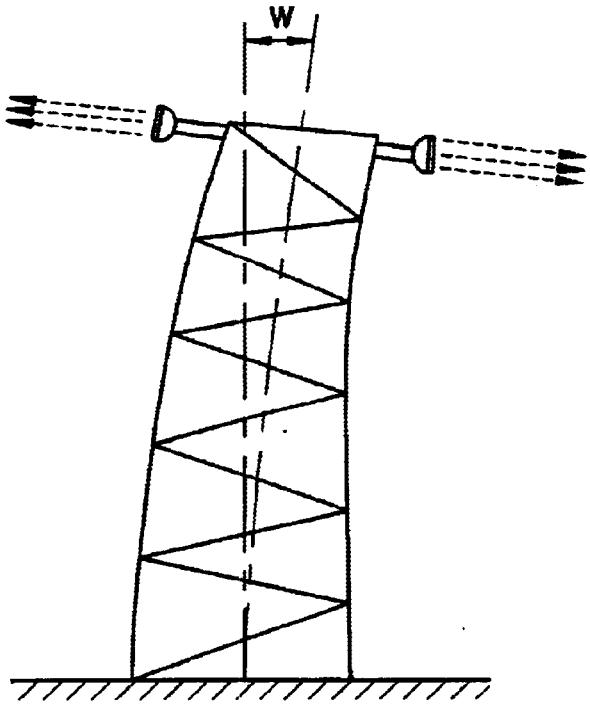
FIG. 1 PRIOR ART
FIG. 1 is a diagram of a conventional antenna in deformation in which one can see the loss of aim characterized by an angle w'.
Figure 2:
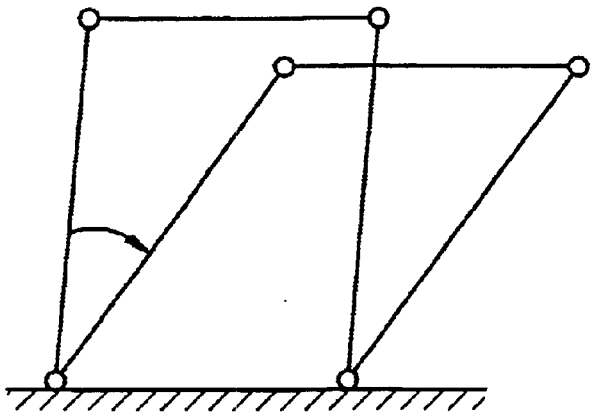
FIG. 2 PRIOR ART
FIG. 2 is a diagram of the deformation of a vertical parallelogram contained in a plane.

Having discussed the problems associated with the acquisition and use of the current antenna support towers, we shall present below the advantages provided by the present invention. We shall emphasize below an antenna support tower for the transmission of GSM signals. Thus, the invention resolves the above cited disadvantages and provides a novel conception of antenna support towers providing the following advantages:

Low wind drag

Reduced weight and footprint

Conservation of the aim of the antennas despite controlled flexibility

Low costs for production, transport/installation and use

Ease of installation on the site

Esthetics

Thus, the present invention pertains to the production of a high-performance antenna support tower with reduced costs of acquisition and use, contributing to better development of the environment and greater convenience and quality for the users. The multiple applications that emerge from these possibilities open perspectives previously unknown in the field of standard antenna support towers.

In its most general sense, the invention pertains to a wireless transmission device constituted by a tower, the upper part of which supports at least one antenna connected to electronic equipment comprising an HF amplifier, characterized in that said electronic equipment is located in the top part of the tower.

The electronic equipment is advantageously enclosed in a structured shelter integral with the tower. The electronic equipment is preferably powered by photovoltaic cells located in the top part of the device. According to an advantageous variant, the device comprises at its top part a rotary inertial mass producing gyroscopic stabilization.

The invention also pertains to a tower for wireless transmission which includes at least one flexible median shaft having at its top part a head located in a plane essentially perpendicular to the shaft, the shaft being equipped with articulated transverse spars, the tower comprising furthermore non-extensible means connecting the head, the spars and the base of the tower to form deformable parallelepiped modules, conserving essentially the parallelism of the spars, the head and the base.

According to a variant, the connecting means are constituted by at least two non-extensible braces arranged at either side of the shaft, attached at one of the ends to the base of the tower and at the other end to the head so as form a deformable parallelogram maintaining the head in an essentially constant plane. The braces are preferably integral with each of the spars so as to form cells the bases and tops of which are maintained in parallel planes.

According to a particular mode of implementation, the spars are connected to the shaft by a recessed articulation along the axis of the shaft, and free in at least one transverse direction and pivoting in relation to at least one transverse axis. According to a variant, the spars are constituted by essentially flat elements and the connecting means comprise 3 braces.

According to a particular mode of implementation, the spars are constituted by essentially flat elements and the connecting means comprise a multiplicity of flexible rods. The head preferably has a faired part that can be oriented along a vertical axis. According to an advantageous variant, the head is mounted freely in rotation and presents aerodynamic driving means for creation of gyroscopic stabilization. According to a preferred mode of implementation, the shaft is constituted by a multiplicity of elements that can be recessed.

The invention also pertains to a process for the installation of a tower comprising a lower conical element, characterized in that the conical element is installed, the top end of the conical element is equipped with a winch, the top element is hoisted up to a height allowing it to fit into the lower element and continuing on in this manner until reaching the segment intended to fit into the lower element of conical form.

If one envisages implementation of a flexible support tower enabling conservation of the aim of antennas according to the invention, and more especially according to its modes of application as well as those modes of implementation of its components which have been given preference, one would proceed in the manner below or in a similar manner.

A flexible support tower would be constituted according to the modalities below:

The central principal body is constituted by the tower itself, either in classic trellis form or as tubular sections or, for smaller sizes, as a single tube (monotube). In our illustrated preferred embodiment, the sections are portions of telescopically fit together cones.

At the bottom part, a base which is, e.g., circular or more simply square, is either bolted onto a solidly established structure or directly embedded or buried.

Figure 5:
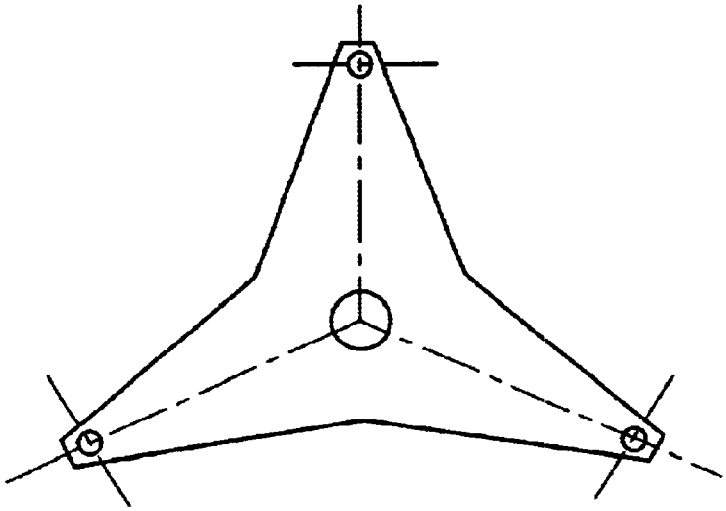
FIG. 5 represents the top monobloc star antenna support.

At the upper part, a central rigid star with three branches the ends of which function as top anchoring points for the tensioning devices (FIG. 5).

Figure 3:
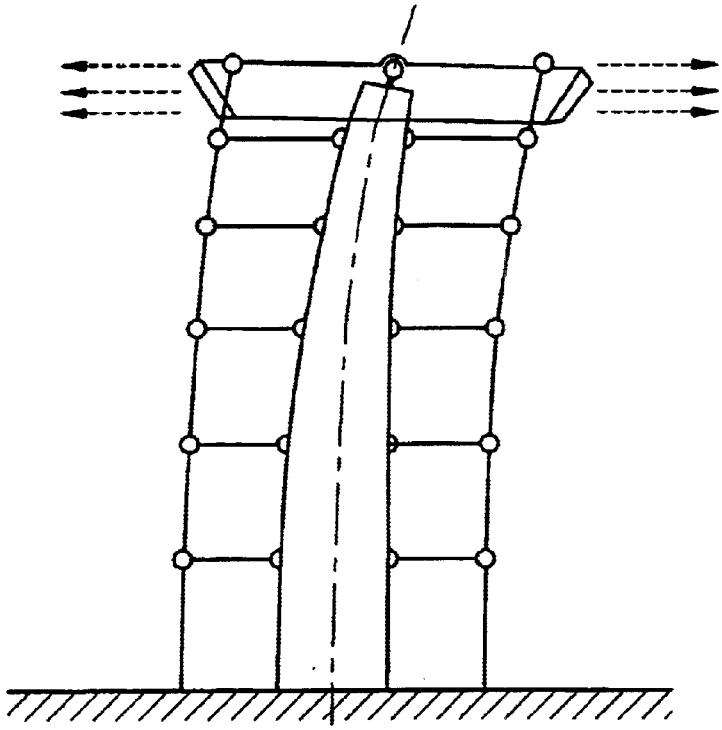
FIG. 3 is a profile diagram of the support tower according to the invention, shown in deformation.
Figure 4:
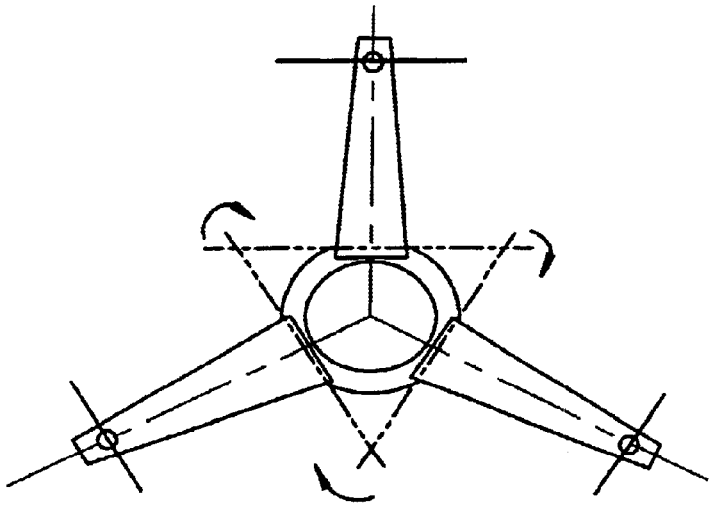
FIG. 4 is a view of one level of the deformable tensioning device or star.

At different intermediary levels, the three-branch star which functions as tensioning device is constituted of articulated horizontal arms (connecting rods), each along a horizontal axis tangential to a circle concentric with the central support. These rigid arms are constituted in a monobloc manner or as a three-dimensional structure of the trellis type. The successive arms are vertically coplanar such that only three vertical planes intersecting at 120° are sufficient to contain all of the planes of symmetry of the upper and intermediary branches (FIGS. 3 and 4).

So as to clearly define the elementary parallelograms constituted by the tower sections, the connector rods and the tensioning parts, these tensioning parts are immobilized at the level of the ends of the arms by parts of the packing box type through which passes the tensioning part of circular section such as, e.g., a cable. Locking of the nut makes it possible to interlock these elements.

The articulation of the top star in the preferred option is designed like the lower yoke of the Cardan joint which is integral with the end of the support tower and simultaneously locked in rotation. The top yoke is integral with the diffusion and reception antennas irrespective of the form of this antenna support and is also locked in rotation by this fact. The Cardan joint does not rotate in the manner of a movement transmission element between shafts. The possible movements for the Cardan joint are only those of pivoting around the axes of the horizontal cross-piece (FIG. 5). A mechanically equivalent system is that of a torque ball the joining piece of which would meet with the axis of the end of the support tower.

When certain support towers comprise a shelter, customarily used for the devices, there are two possibilities: direct installation on the body of the tower or integral with the support cage of the antennas in a manner such that this shelter can also conserve its horizontal orientation under all flexion conditions.

One possibility tending to diminish the drag of the assembly is that of providing for the positioning of the shelter in a clearly lower position without the level being such that the equipment would be exposed to vandalism.

Bracing: in the preferred option, the invention enables elimination of bracing wires. Nevertheless, even if in certain cases it is necessary to provide bracing wires, e.g., because of insufficient security of the foundations or desired limitation of flexion, the invention makes it possible to limit the extend of bracing and reduce the covered surface at the ground, as well as the number of attachment points.

Moreover, the points of attachment to the tower can be limited to a low level rather than be distributed over the entire height of the tower.

Behavior of the antenna support tower with the wind:

From that stated above, it is easy to understand that the invention, going beyond the prior art in rigidity of towers, while ensuring maintenance of aim under all conditions, will best be applied when the flexibility of the towers is best understood, which can result from the usual material resistance calculations. The three tensioning cables, which should have clearly determined mechanical characteristics, should be calculated to maintain a pretensioning on the body of the support tower. In this manner, any flexion of the support tower will enable the tensioning part under the wind to bring the antenna cage into the horizontal position, the two others not having the possibility of being really relaxed while exerting a permanent stabilizing effect.

It is apparent that only careful calculation will enable determination of the pretensioning values in relation to the operating conditions. Nevertheless, the simplicity of implementation of the procedure can be seen.

With regard to the components, the invention is distinguished by the implementation of special elements assuring the precision and security of assembly and durable operation:

light, robust arms equipped with packing box, truncated portions whose connections as well as particular attachment modes we propose to define, wear-free articulations, lifetime lubrication.

There is the possibility in relation to the integral trellis systems to locate the conductive cables inside the tubes and thus protected from the weather.

Moreover, the modalities of producing and using this assembly are themselves capable of many transpositions especially in relation to the general dimensions, installation and predicted weather conditions. Thus, for the support towers of the common dimensions close to twenty meters, a simple conception of the central body is that of two or three superposed sections, bolted to each other by external straps. Even simpler, a monobloc body can be conceived when the transport conditions do not constitute an excessively unfavorable or unacceptable factor.

It should also be noted that the preferred arrangement of the invention enabling interior passage of the cables increases their shielding. The invention is naturally conceivable in many variants, depending in particular on the materials, the environmental conditions, esthetics and the like.

One certainly advantageous conception enabled by the invention is that already mentioned consisting of a central body comprised of multiple telescoping truncated sections, one particularly simple and useful arrangement of which consists of a robust assembly by straps or by a strap attached to the exterior of the lower part of the above section and a strap attached on the inside of the tube below in its top part.

Another variant concerns a device presenting a bottom trellis-like part upon which rests a top sectional part made of an envelope such as a tube. Two devices can also be applied at the level of the top star to ensure free articulation: the first consists of an articulated cone, type of a flat ring arranged on inclined convergent feet and the second consists of an elastic lever similar to a joystick in form.

Figure 6:
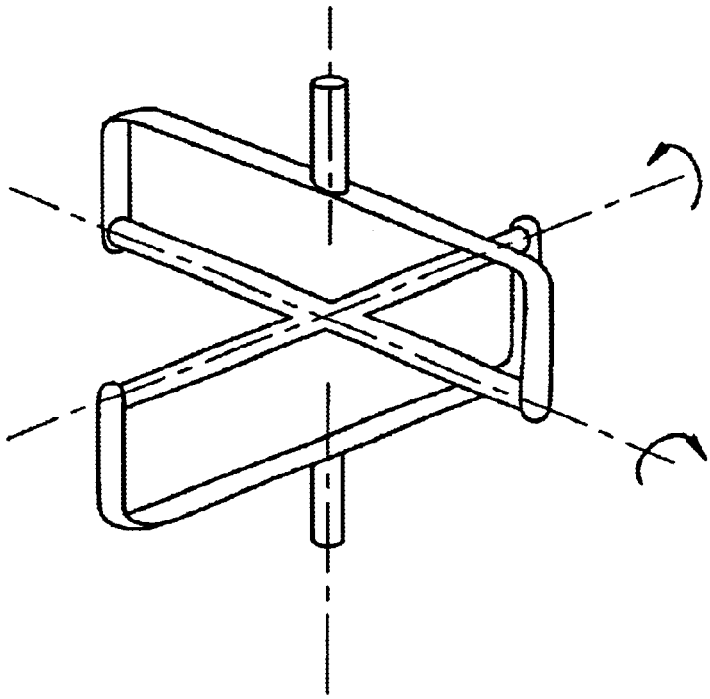
FIG. 6 represents a preferred Cardan joint.
Figure 7:
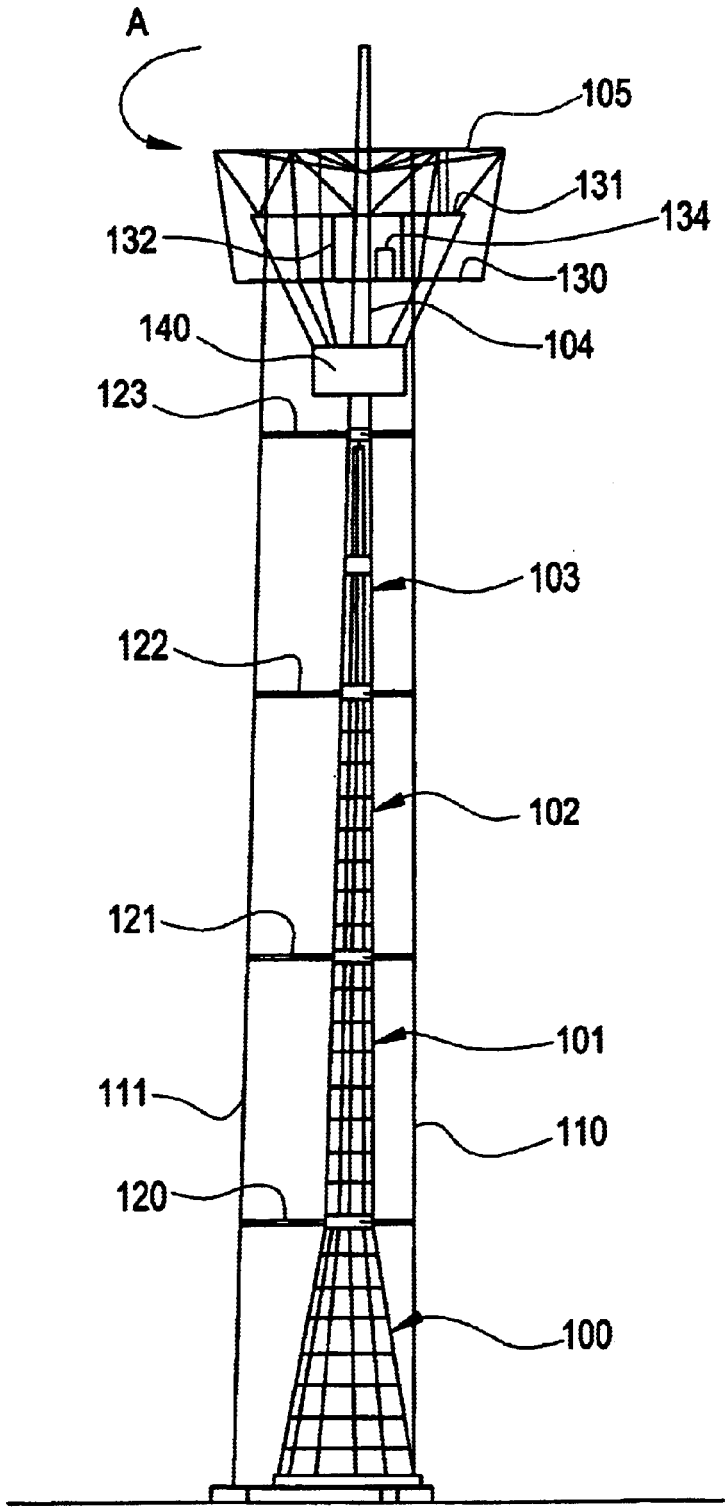
FIG. 7 represents another example of implementation.

FIG. 6 represents a variant of implementation.

The device comprises a bearing shaft having a lower section (100) formed by a conical metal trellis extended by a multiplicity of sections (101 to 104) nested into each other. The shaft supports at its top end a head (105) articulated such that it can pivot and move transversely. The head 105 is also mounted freely in rotation and presents aerodynamic driving means for creation of gyroscopic stabilization, as shown by arrow A.

Braces (110, 111) ensure the parallelism of the head (105) with the base of the device and maintenance of the head in an essentially constant plane, even when the shaft flexes under the action of the wind. The spars (120 to 123) are articulated in relation to the shaft and form with the braces deformable cells, conserving the parallelism of the spars. The top part has multiple platforms (130, 131) maintained parallel by the braces (110, 111) and articulated to enable pivoting and transverse displacement like the spars. These platforms allow placement of the antennas (132) and an HF amplifier 134.

The shaft also supports a shelter(140) enclosing the electronic equipment. Thus, one avoids line losses caused by the cables connecting the antennas to the electronic equipment which is usually placed at the bottom of the tower. This shelter has a double skin to improve thermal exchanges.

Assembly is implemented by first installing the conical trellis structure (100). Then a winch is installed at the top part of this structure (100). The winch hoists up the top section (103) equipped with the head until its base reaches a height allowing it to fit into the lower section (102). This operation of hoisting with the winch the newly introduced section to place the following section is repeated until the shaft is finally raised.

The braces are attached on the head at the beginning of the operation and serve as bracing during the provision phase. They are then subjected to a slight stress to equilibrate the shaft.

What is claimed is:

1. A tower for a wireless transmission device comprising at least one shaft and transverse spars, wherein the transverse spars are articulated in relation to the shaft and form with braces cells conserving the parallelism of said spars, wherein the spars are connected to the shaft by a recessed articulation along an axis extending along the shaft, and free in at least one transverse direction and pivoting in relation to at least one transverse axis.

2. The tower according to claim 1, wherein connecting means comprising at least two inextensible braces arranged at either side of the shaft, attached at one end to a base of the tower and at another end to a head of the tower, form a deformable parallelogram maintaining the head in an essentially constant plane.

3. The tower according to claim 2, wherein the braces are integral with each of the spars to form cells having bases and tops, the bases and tops being maintained in parallel planes.

4. The tower according to claim 2, wherein the spars are essentially flat elements and the connecting means comprise 3 braces.

5. The tower according to claim 2, wherein the spars are essentially flat elements and the connecting means comprise a multiplicity of flexible rods.

6. The tower according to claim 1, wherein the head has a faired part oriented along a vertical axis.

7. The tower according to claim 6, wherein the head is mounted freely in rotation and has aerodynamic driving means for creation of gyroscopic stabilization.

8. The tower according to claim 1, wherein the shaft is a multiplicity of elements that can be recessed.

9. The tower according to claim 8, wherein a bottom element is of conical form.

10. A process for installing a tower according to claim 9, comprising:

equipping a top end of the conical element with a winch;

installing the conical element on a base; and hoisting up a top element to a height allowing the top element to fit into a lower element and repeating until reaching a segment intended to fit into the conical element.

11. A wireless transmission device comprising a tower according to claim 1, an upper part of which supports at least one antenna connected to electronic equipment comprising an HF amplifier located in a top part of the tower, said tower comprising at least one flexible median shaft having at a top part thereof a head located in a plane essentially perpendicular to the shaft, the shaft being equipped with articulated transverse spars, the tower further comprising non-extensible means connecting the head, the spars and a base of the tower to form deformable parallelepiped modules, conserving essentially the parallelism of the spars, the head and the base.

12. The wireless transmission device according to claim 11, wherein the electronic equipment is enclosed in a structured shelter integral with the tower.

13. The wireless transmission device according to claim 12, wherein the electronic equipment is powered by photovoltaic cells located in the top part of the device.

14. The wireless transmission device according to claim 11, wherein the top part comprises a rotary inertial mass producing gyroscopic stabilization.

15. A tower for a wireless transmission device comprising;

at least one shaft extending upwardly between top and bottom portions;

transverse spars extending outwardly from the shaft; and at least one brace connected to at least one of the spars and extending between the top and bottom portions, wherein the transverse spars are articulated in relation to the shaft and form, in conjunction with the braces, cells to maintain parallelism of the spars, wherein the spars are connected to the shaft by a recessed articulation along an axis extending along the shaft, and free in at least one transverse direction and pivoting in relation to at least one transverse axis.

16. The tower according to claim 15, further comprising at least two braces arranged at either side of the shaft and attached at one end to the bottom portion of the tower and at another end to the upper portion to form a deformable parallelogram maintaining the upper portion in an essentially constant plane.

17. The two according to claim 16, wherein the braces are integral with each of the spars to form cells having bases and tops, the bases and tops being maintained in parallel planes.

18. The tower according to claim 15, wherein the spars comprise essentially flat elements connected to 3 braces.

* * * * *